US006641170B2

(12) United States Patent
Yip

(10) Patent No.: US 6,641,170 B2
(45) Date of Patent: Nov. 4, 2003

(54) CHILDREN'S SOUND BOOK

(76) Inventor: Winnie Yip, 58 W. Saddle River Rd., Saddle River, NJ (US) 07458

( * ) Notice: Subject to any disclaimer, the term of this patent is extended or adjusted under 35 U.S.C. 154(b) by 0 days.

(21) Appl. No.: 09/965,091

(22) Filed: Sep. 27, 2001

(65) Prior Publication Data

US 2003/0057696 A1 Mar. 27, 2003

(51) Int. Cl.[7] ..... B42D 3/00

(52) U.S. Cl. ..... 281/29; 281/36; 281/37; 281/38; 281/51; 434/317

(58) Field of Search ..... 281/29, 36, 37, 281/51; 402/70, 73; 434/317, 327, 339, 169

(56) References Cited

U.S. PATENT DOCUMENTS 5,235,974 A * 8/1993 Miller ..... 607/108
5,356,296 A * 10/1994 Pierce et al. ..... 434/317
5,997,304 A * 12/1999 Wood ..... 434/169

* cited by examiner

*Primary Examiner*—Willmon Fridie, Jr.
(74) *Attorney, Agent, or Firm*—Richard A. Joel, Esq.

(57) ABSTRACT

This invention relates to children's sound books and in particular to books having a fabric covering with sound chips positioned therein and an overlapping cover which closes and locks due to hook and loop fasteners. This invention involves a folding cloth covered book that is appealing to children, pleasant to touch and stretches out into an elongated representation of the book subject matter. Sound chips and a controller are mounted between cloth layers and are coupled to a controller similarly mounted to emit sounds when a particular representation is contacted. The books are intended for children 6 months old and above.

2 Claims, 5 Drawing Sheets

CHILDREN'S SOUND BOOK

CROSS-REFERENCE TO RELATED APPLICATIONS

None

STATEMENT REGARDING FEDERALLY SPONSORED RESEARCH OR DEVELOPMENT

Research and development of the present invention and application have not been federally sponsored, and no rights are given under any Federal program.

REFERENCE TO A MICROFICHE APPENDIX

None

BACKGROUND OF THE INVENTION

1. Field of the Invention

This invention relates to children's sound books and in particular to books having a fabric covering with sound chips positioned within the fabric covering representing various animals, etc. and an overlapping cover which closes and locks due to hook and loop fasteners. Touching the animals activates a controller that causes a sound to emanate from the representation.

2. Description of the Related Art Including Information Disclosed under 37 CFR §§1.97–1.98

The prior art includes numerous books for young children generally made of plastic or paper materials. This prior art includes books that show animals, letters, numbers, etc. and even books that reproduce sounds representative of the animals or letters depicted therein. This invention, however, involves a folding cloth covered book which is appealing to children, pleasant to touch and stretches out into an elongated representation of the book subject matter. Sound chips or a microphone are mounted between cloth layers and are coupled to a controller similarly mounted to emit sounds when a particular representation is contacted. The books are intended for babies 6 months old and above. The books provide both entertainment and a learning experience.

SUMMARY OF THE INVENTION

A book for young children comprises a fabric-covered structure having a base and folding portions at each end that overlap and are secured together with VELCRO® or hook and loop fasteners. The interior of the book in an open position has various representations such as animals, letters, numbers, etc. which when contacted by the child emit a sound representative of that designation. The book includes a plurality of sound chips coupled to a controller operated by batteries. Activating a particular switch causes a sound to be emitted from that particular location. The animals, numbers and so forth are raised representations that are sewn to the fabric background and readily accommodate a particular sound chip or monitor in the raised portion thereof. The raised designations provide a more realistic image of the representation and are pleasant to touch and feel.

The books of the invention contain pictures and sounds that are attractive to babies and small children and create a mental association. This relationship can motivate children to start reading early. If children follow a series of applicant's books, they should be able to read "A-B-C's" and some simple words by 12 to 24 months. This preschool knowledge will greatly assist them when they start school.

The invention may include specifically books on "A-B-C; 1-2-3" and simple words such as animals, toys and stories.

Accordingly, an object of this invention is to provide a new and improved children's book that is attractive and appealing to small children.

A further object of this invention is to provide a fabric covered sound book for small children wherein touching a particular designation causes a related sound to be emitted.

A still further object of this invention is to provide a new and improved children's book wherein the book has raised designations containing switches or sound chips beneath the fabric overlay in order to relay sounds to the particular designations upon contact.

A more specific object of this invention is to provide a fabric covered children's book wherein the front cover is held together with VELCRO® or hook and loop fasteners and includes sound devices mounted between the front and rear covers beneath a raised fabric representation and activated by touch.

BRIEF DESCRIPTION OF THE DRAWINGS

The above and other objects of the invention may be more readily seen when viewing in conjunction with the accompanying drawings wherein.

DETAILED DESCRIPTION OF THE INVENTION

Figure 1:
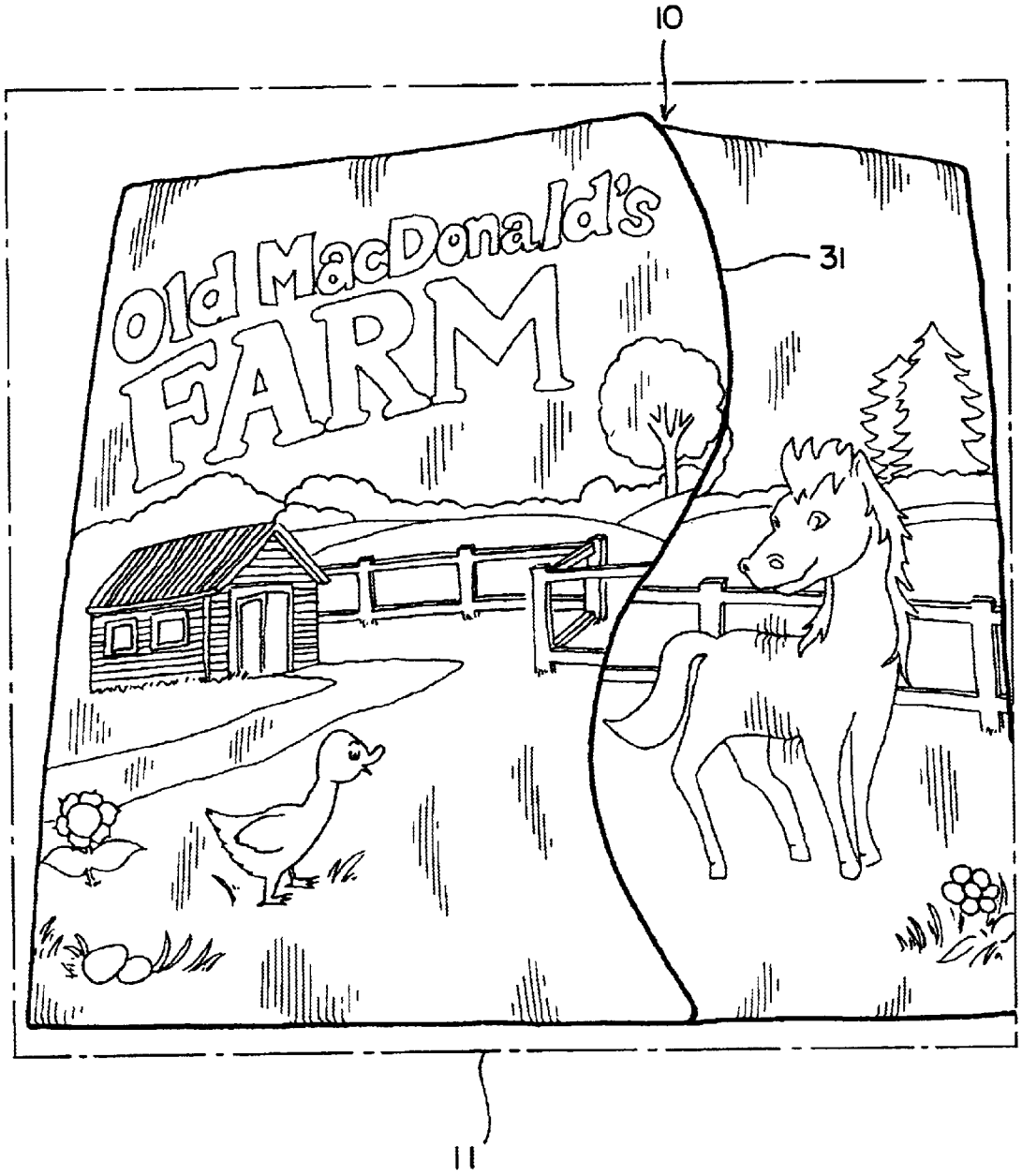
FIG. 1 is a representation of the book in a closed position.
Figure 2:
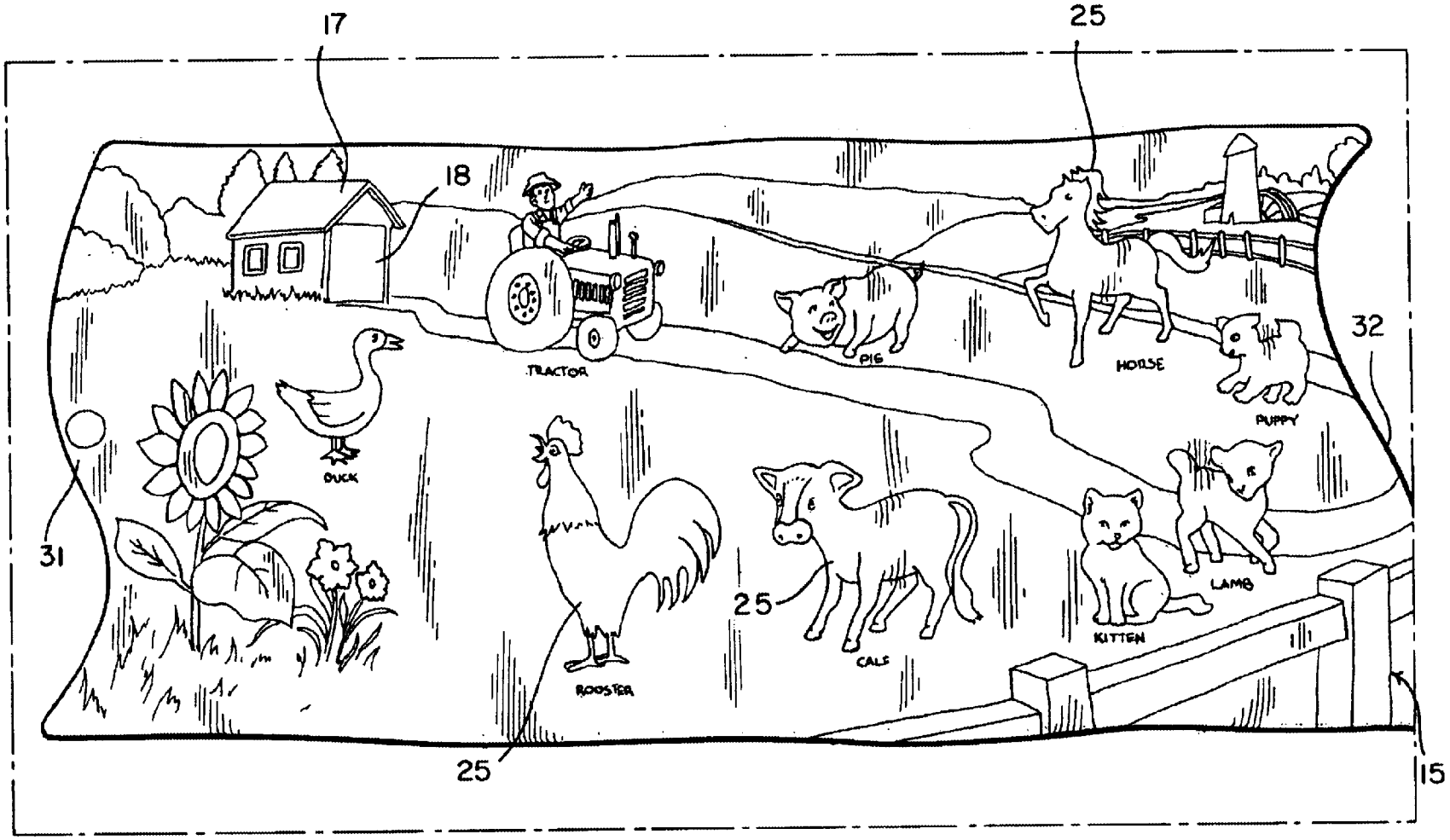
FIG. 2 is a representation of the book in a front opened position.
Figure 3:
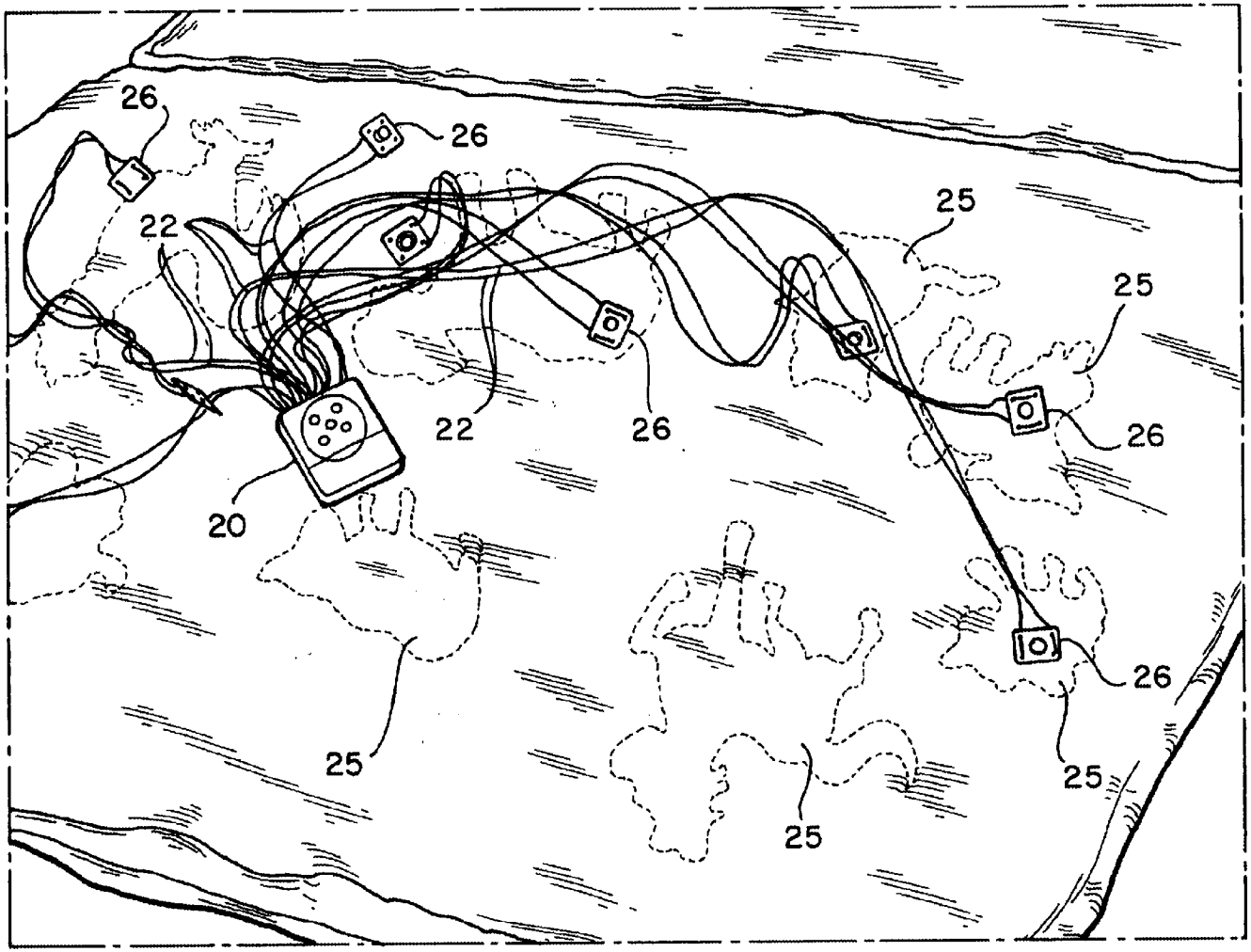
FIG. 3 shows the sound chips and controller on the interior of the fabric cover.
Figure 4:
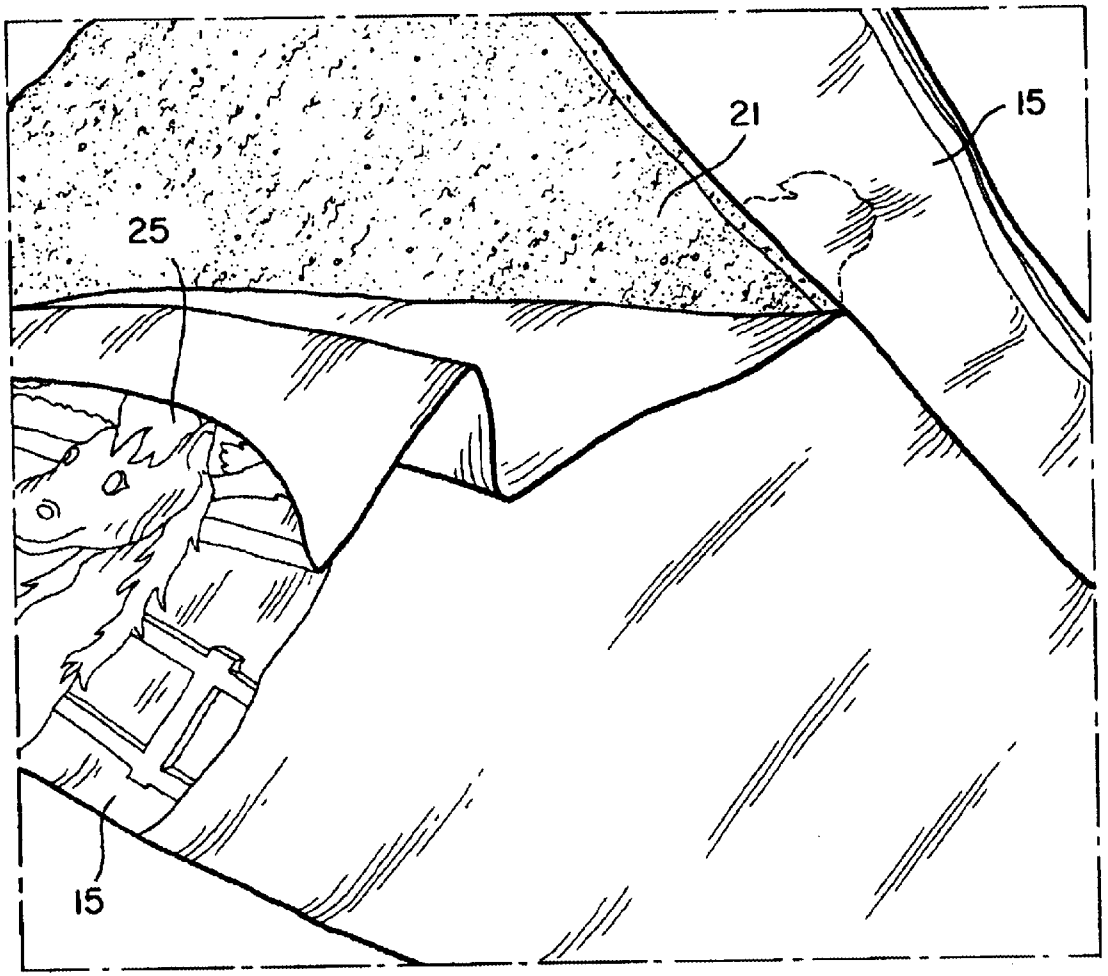
FIG. 4 shows the front cover peeled back to reveal internal insulation.

Referring now to the drawings, the invention comprises a sound book 10 for small children which includes an elongated base 11 having end portions 12, 13 which fold outwardly at 23 and 24 respectively and wherein end portion 12 overlaps end portion 13. The ends 12, 13 are secured together by VELCRO® or hook and loop fasteners 14*a*, 14*b* and edges 31, 32 have a curved configuration.

The book 10 as represented in FIG. 1 discloses representations 25 of farm animals such as horses, roosters, cows, etc, but the book 10 may alternatively disclose letters, numbers, words, etc. The book 10 is covered on the outside with fabric 15 so that is pleasant to the touch. The animals 25 depicted thereon are raised representations sewn directly to the fabric 15.

Figure 5:
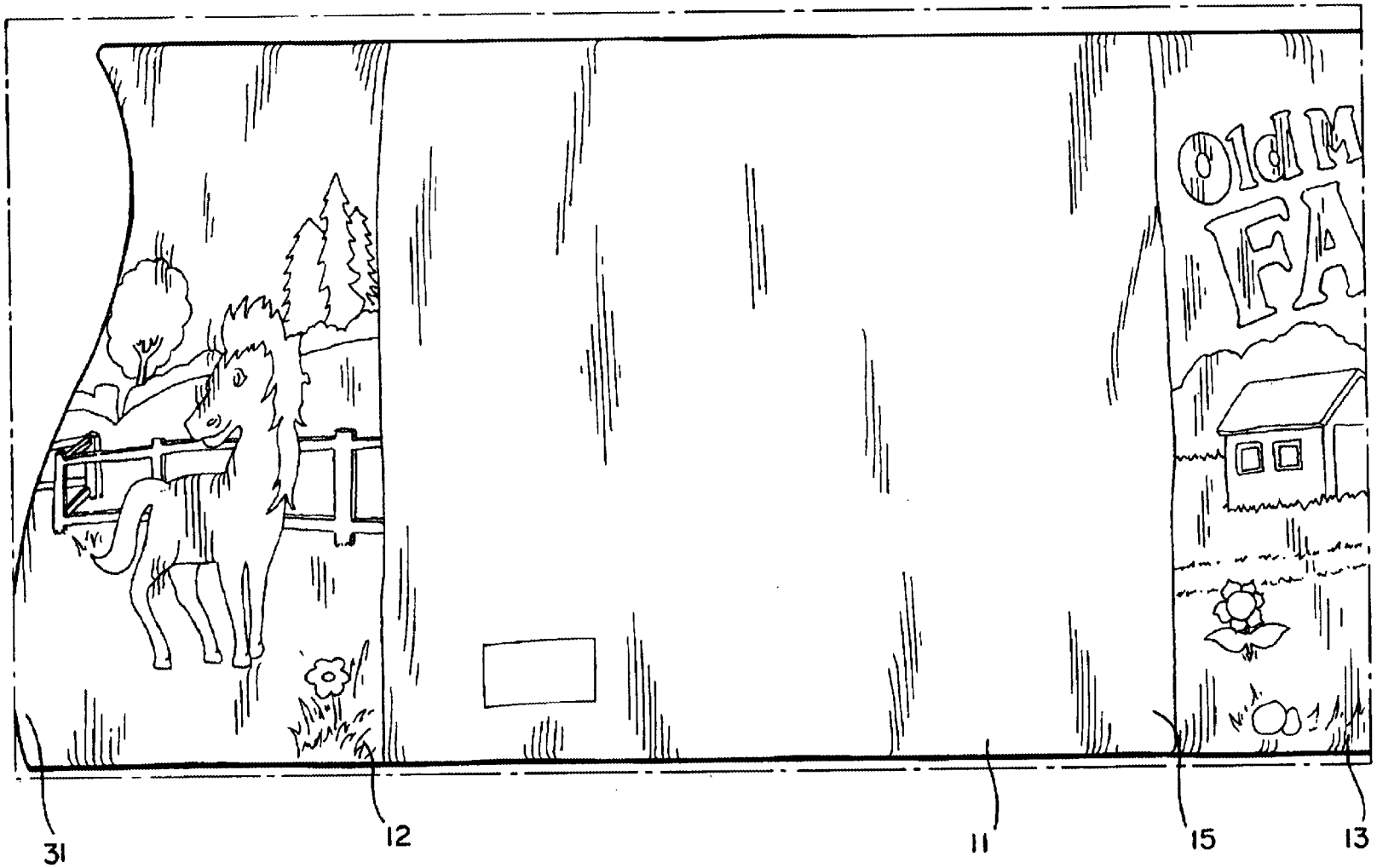
FIG. 5 shows the rear of the book in an open position.

The base portion 11 is covered with fabric 15 as shown in FIG. 5 and the end portions 12, 13 reveal a plurality of animals, flowers and tractors 16. These representations 16 are sewn to the fabric 15 but do not have sound mechanisms mounted thereunder. Other decorative pictures may be printed on the fabric.

A barn representation is also shown at 17 on the front portion 15 wherein the entrance 18 is attached by VELCRO® or hook and loop fasteners (not shown). Lifting the entrance 18 reveals batteries 19 and a control element 20 for the sounds. A plastic inner layer 21 protects the wires 22 that run to the various animals 16 from the control element 20.

In use, the book 10 is opened by detaching VELCRO® or hook and loop fasteners 14*a*, 14*b* on the end portion 12 from the end portion 13. One fastener 14*a* is on the rear portion of the fold 13 while the other fastener on the front portion of fold 12. Curved edges 23 and 24 overlap to provide a cover for the book 10.

The book 10 includes a plurality of raised representations 25 such as animals, etc. that are sewn onto the fabric 15 to provide conspicuous raised representations. Mounted beneath each animal 25 is a sound chip 26 that emits a sound corresponding to the representation 25 upon touch. The sound chips 26 are connected by wires 22 to the controller 20 that activates the sound chips 26 when the circuit is closed by touch. The base interior portion includes an insulating layer 21 that is located internally of the fabric 15 outer layer.

The end folds 12 and 13 include representations on the outer portion thereof that become highly visible when they are folded onto one another to form a cover. The base portion 28 merely forms a backing for the book 10.

While the invention has been explained by a detailed description of certain specific embodiments, it is understood that various modifications and substitutions can be made in any of them within the scope of the appended claims, which are intended also to include equivalents of such embodiments.

What is claimed is:

1. A sound book for small children having representations which emit corresponding sounds upon touch comprising:

a rear fabric portion having elongated sides and curved end portions having edges;

a front fabric portion having edges sewn to the rear fabric portion edges and having a plurality of raised representations mounted at predetermined locations thereon;

a plurality of sound means to emit a sound each mounted beneath a raised representation to which the sound corresponds;

a controller activated by touching a particular representation to cause sounds to be emitted from the particular sound means corresponding to the representation;

means coupling the controller to the sound means batteries mounted within the controller to provide a power source;

a removable fabric portion on the front fabric portion having hook and loop fasteners;

mating hook and loop fasteners on the front fabric portion to engage the hook and loop fasteners of the removable fabric portion;

wherein the controller is mounted beneath the removable fabric portion, a layer of insulating material mounted between the front fabric portion and the rear fabric portion, and;

wherein the front and rear fabric portions include transverse folds forming two folds such that the rear portions overlap and cover the front fabric portion.

2. A sound book for small children having representations that emit corresponding sounds upon touch in accordance with claim 1 herein:

the fold on the front fabric portion includes a hook and loop fastener; and, the opposite fold on the rear fabric portion includes a hook and loop fastener to engage the fastener on the overlapping front fabric portion.

* * * * *